United States Patent [19]

Keuchel

[11] 4,085,175

[45] Apr. 18, 1978

[54] PROCESS FOR PRODUCING A BALANCED NONWOVEN FIBROUS NETWORK BY RADIAL EXTRUSION AND FIBRILLATION

[75] Inventor: Herbert W. Keuchel, Tallmadge, Ohio

[73] Assignee: PNC Corporation, Wycoff, N.J.

[21] Appl. No.: 613,093

[22] Filed: Sep. 15, 1975

Related U.S. Application Data

[63] Continuation of Ser. No. 500,108, Aug. 23, 1974, abandoned.

[51] Int. Cl.[2] ..... B29D 7/02; B29D 7/24; B29D 27/00

[52] U.S. Cl. ..... 264/51; 264/210 R; 264/DIG. 5; 264/DIG. 8; 425/382 R; 425/DIG. 53; 428/224; 428/397; 428/910

[58] Field of Search ..... 264/51, 53, DIG. 8, 264/210 R, DIG. 5; 428/224, 397, 910; 425/382 R, DIG. 53

[56] References Cited

U.S. PATENT DOCUMENTS

| | | | |
|---|---|---|---|
| 2,852,813 | 9/1958 | Longstreth | 264/210 R X |
| 3,079,636 | 3/1963 | Aykanian | 264/53 X |
| 3,378,614 | 4/1968 | Overcashier | 264/51 |
| 3,539,666 | 11/1970 | Schirmer | 264/DIG. 8 |
| 3,562,369 | 2/1971 | Chopra et al. | 264/DIG. 8 |
| 3,634,564 | 1/1972 | Okamoto et al. | 264/DIG. 8 |
| 3,789,095 | 1/1974 | Winstead | 264/51 |
| 3,954,928 | 5/1976 | Omori et al. | 264/51 |
| 3,965,229 | 6/1976 | Driscoll | 264/53 X |
| 3,969,472 | 7/1976 | Driscoll | 264/53 X |

FOREIGN PATENT DOCUMENTS

| | | | |
|---|---|---|---|
| 1,098,770 | 1/1968 | United Kingdom | 264/DIG. 8 |
| 1,157,299 | 7/1969 | United Kingdom | 264/DIG. 8 |
| 1,192,132 | 5/1970 | United Kingdom | 264/DIG. 8 |
| 1,221,488 | 2/1971 | United Kingdom | 264/DIG. 8 |

OTHER PUBLICATIONS

Brydson, J. A., "Plastics Materials", Princeton, N. J., P. Van Nostrand, 1966, pp. 33–36.

*Primary Examiner*—Philip Anderson
*Attorney, Agent, or Firm*—John E. Benoit

[57] ABSTRACT

Self-bonded, balanced nonwoven fibrous fabrics having fibers uniaxially oriented and junction points of biaxially oriented film tissue and fibers in the plane of the fabric, the fibers being primarily oriented in the machine direction with the biaxially oriented film tissue being oriented in the cross direction. The nonwoven fabrics are produced by extruding a molten polymer radially from a circular die, quenching and then drawing the extrudate.

4 Claims, 2 Drawing Figures

PROCESS FOR PRODUCING A BALANCED NONWOVEN FIBROUS NETWORK BY RADIAL EXTRUSION AND FIBRILLATION

This is a continuation of application Ser. No. 500,108, filed Aug. 23, 1974, and now abandoned.

The present invention relates to methods for producing balanced nonwoven fibrous networks. Balanced nonwoven fibrous networks are those networks which are composed of fibers arranged randomly in the plane of the fabric. The fibers are interconnected at junctions which are biaxially oriented. These junctions may be composed of enlarged fibers, flat fibers and/or biaxially oriented film tissues.

Nonwoven fibrous networks are well known products. These fabrics have been made in the past a wide variety of uses including such fibers as cotton, flax, wood, silk, wool, jute, asbestos; mineral fibers such as glass; artificial fibers such as viscose rayon, cupra-ammonium rayon, ethyl cellulose or cellulose acetate; synthetic fibers such as polyamides, polyesters, polyolefins, polymers of vinylidene chloride, polyvinyl chloride, polyurethane, alone or in combination with one another.

The methods for producing nonwoven fabrics in the past have generally involved expensive and time consuming operations. In making nonwoven fabrics from synthetic materials, e.g., rayon, polyethylene, the process generally included the fiber production steps, i.e., spinning of the filament; bleaching, washing, etc., as required; and cutting or chopping into fibers which were dried and baled for shipment to the user. Ordinarily the fibers were unbaled or unpackaged, cleaned, "opened" so as to straighten out all curled, bent and/or twisted fibers, and carded to form a continuous web. This continuous web is very directional in the machine direction. (All of the fibers are brushed in one direction.) Cross-lapping is usually required to produce balanced webs. The fibers were then bonded together in some manner in order to form the finished nonwoven fabric. The fibrillation of extruded polymeric materials has recently attracted the attention of the textile industry because in comparison with polymers extruded by spinneret methods to form filament yarn, tow, staple and monofilament, the extrusion of extrudates, whch can be subsequently subjected to fibrillation techniques, results in higher production rates and lower costs of equipment and, therefore, lower consumption of energy. The primary economic advantage of fibrillation technology is the direct conversion from a polymer melt to a textile product without spinning and its necessary related operations. Polyolefins, particularly polypropylene and polyethylene resins, are especially suited for a fibrillation process. Polyolefin resin is converted, in a number of processes, into unoriented film by a melt casting process and may be uniaxially oriented in a hot-stretching zone, and mechanically worked to produce the fibrillated product.

It is, therefore, an object of the present invention to provide a new method for the production of a fibrillated nonwoven fabric.

It is another object of the present invention to provide a method for the production of a fibrillated nonwoven fabric having a balanced fibrous network.

It is yet another object of the present invention to provide a method for the production of a nonwoven fabric having a balance in fiber spacings and properties and biaxially oriented junction areas, produced by a radial extrusion and fibrillation process.

In accordance with the present invention, a fibrillated polymeric product may be produced utilizing a process which comprises extruding a molten polymer radially through a circular die to form a cellular product. The molten polymer comprises a mixture containing a molten thermoplastic polymer, such as polypropylene, and a foaming agent which is or evolves gas at the temperature of extrusion. Upon emerging from the circular extrusion die, the extrudate is quenched and its temperature substantially lowered below the melting or flow temperature of the polymer and subsequently subjected to a drawing operation which is preferably above the glass transition temperature, but below the melting or flow point of the polymer, in order to facilitate stretching and to promote crystalline orientation of the polymeric material. In general, the preferred temperature of orientation coincides with the temperature which promotes the highest rate of crystallinity for a given polymer system. It is understood, however, that noncrystalline resins also may be oriented.

In the preferred process of the present invention, a cellular product is extruded radially (360°) from a circular extrusion die. An attenuated network or foam forms upon extrusion from the die, which network is quenched on both sides thereof, preferably utilizing two parallel opposed air rings, whereupon the extrudate is further drawn down and changes from a melt to a plastic and/or solid polymeric substrate. Preferably, the extrudate is quenched until it cools to a temperature substantially below the melting or flow temperature of the polymer. The quenched extrudate is then heated, preferably to a temperature between the glass transition temperature and melting temperature of the polymer utilizing a heated ring. This facilitates stretching and crystalline orientation of the polymeric extrudate. The extrudate is then cooled, preferably to a temperature substantially below the melting or flow temperature of the polymer, and is substantially uniformly stretched, preferably over the outside of a ring or rolls utilizing elastic expansion. The product may then be taken up or optionally slit prior to take up to provide a substantially flat fibrous structure.

The polymer melt, prior to extrusion, may also contain additives other than a foaming agent, such as a deodorizer, a coloring component or a reinforcing agent. The extrudate may be dope dyed or if piece dyeing is desired, a compound for improving dye receptivity may be included.

The process and apparatus of the present invention can be utilized for any of the thermoplastic resins which can be formed into shaped articles by melt extrusion. Among the polymers which are suitable are: polymers and/or copolymers of vinylidene compounds such as ethylene, propylene, butene, methyl-3-butene, styrene, vinyl chloride, vinylidene chloride, tetrafluoroethylene, hexafluoropropylene, methyl methacrylate and methyl acrylate, polyamides such as polyhexamethylene adipamide and polycaprolactam, polyacetals, thermoplastic polyurethanes, cellulose esters of acetic acid, propionic acid, butyric acid and the like, polycarbonate resins and the like. Resins which have been found to be especially adaptable for use in the present invention include high density polyethylene and polypropylene, thermoplastic polyurethanes, linear polyesters such as polyethylene terephthalate, nylon copolymers, vinyl polymers and copolymers, nylon terpolymers.

In the preferred embodiment, the molten extrudate is extruded into a quenching zone wherein a cooling medium lowers the temperature of the polymeric extrudate to a temperature below the melting or flow temperature and the extrudate is subsequently orientated. Therefor, it is preferred that the polymeric material being extruded be capable of exhibiting a high degree of orientation, as is characteristic of polyolefins such as polypropylene and polyethylene.

Any of a great number of foaming agents may be utilized with the present invention. Solids or liquids which evaporate or decompose into gaseous products at the temperature of extrusion, as well as volatile liquids, may be utilized. Solids which may be utilized include azoisobutyric dinitrile, diazoamino benzene, 1,3 bis(p-xenyl) triazine, azodicarbonamide and similar azo compounds which decompose at temperatures below the extrusion temperature of the composition. Other solid foaming agents include ammonium oxalate, oxalic acid, sodium bicarbonate and oleic acid, ammonium bicarbonate and mixtures of ammonium carbonate and sodium nitrite. Volatile liquids which may be utilized as foaming agents include acetone, methyl ethyl ketone, ethyl acetate, methyl chloride, ethyl chloride, chloroform, methylene chloride, and methylene bromide. Foaming agents which are normally gaseos compounds such as nitrogen, carbon dioxide, ammonia, methane, ethane, propane, ethylene, propylene and gaseous halogenated hydrocarbons can also be utilized. Another class of foaming agents are fluorinated hydrocarbon compounds having from 1 to 4 carbon atoms which may also contain chlorine and bromine. Examples of such blowing agents are dichlorodifluoromethane, dichlorofluoromethane, chlorofluoromethane, difluoromethane, chloropentafluoroethane, 1,2-dichlorotetrafluoroethane, 1,1-dichlorotetrafluoroethane, 1,1,2-trichlorotrifluoroethane, 1,1,1-trichlorotrifluoroethane, 2-chloro-1,1,1-trifluoroethane, 2-chloro-1,1,1,2-tetrafluoroethane, 1-chloro-1,1,2,2-tetrafluoroethane, 1,2-dichloro-1,1,2-trifluoroethane, 1-chloro-1,1,2-trifluoroethane, 1-chloro-1,1-difluoroethane, perfluorocyclobutane, perfluoropropane, 1,1,1-trifluoropropane, 1-fluoropropane, 2-fluoropropane, 1,1,1,2,2-pentafluoropropane, 1,1,1,3,3-pentafluoropropane, 1,1,1,2,3,3-hexafluoropropane, 1,1,1-trifluoro-3-chloropropane, trifluoromethylethylene, perfluoropropene and perfluorocyclobutene.

The quantity of foaming agent employed can vary with the density of foam and size of fibers desired (a lower density requiring a greater amount of foaming agent), the nature of the thermoplastic resin and the foaming agent utilized. In general, the concentration of the foaming agent can vary from about 0.25 to about 10 percent, by weight, of the thermoplastic resin.

Figure 1:
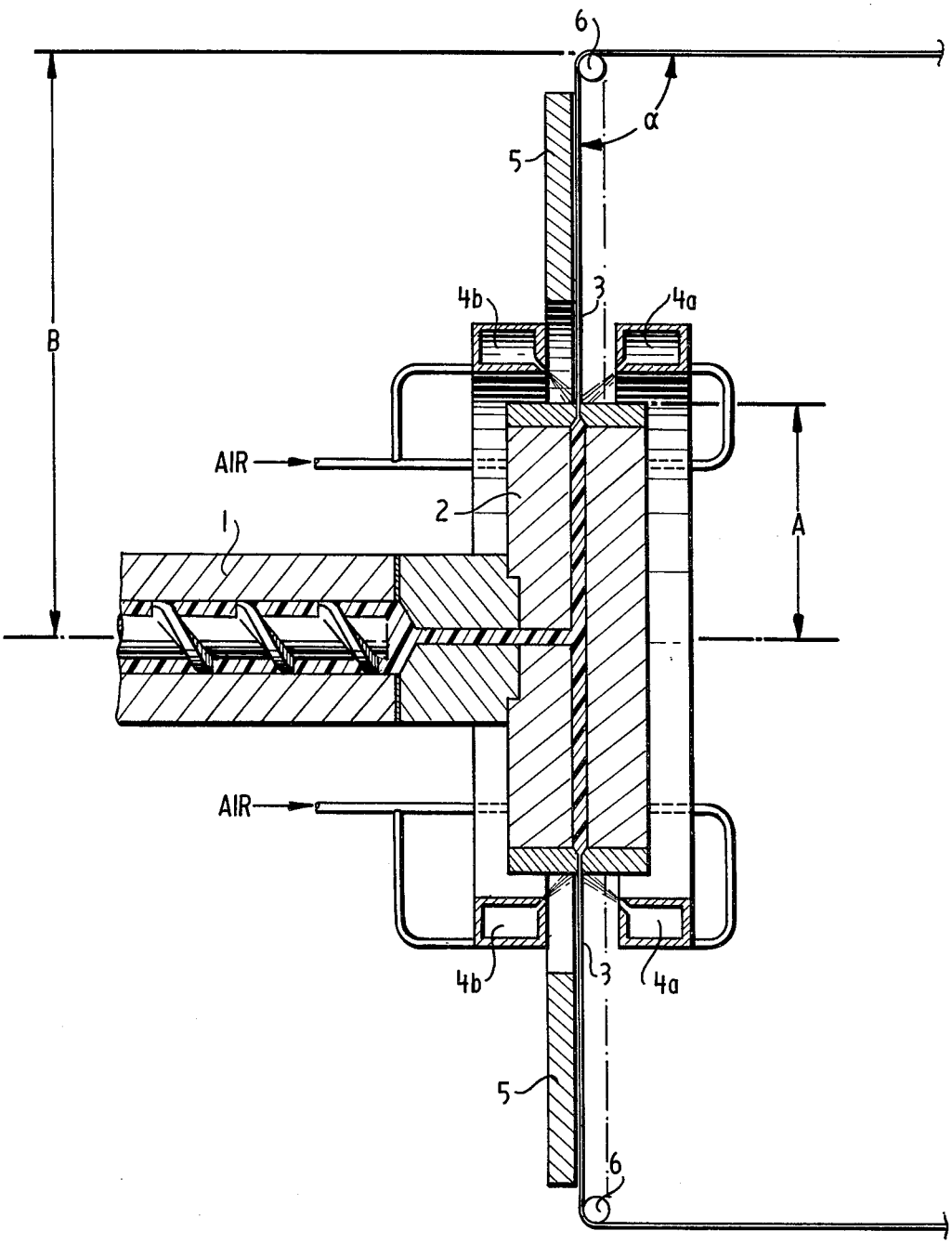
FIG. 1 is an illustration of the preferred process and apparatus of the present invention.

A molten polymer is extruded through extruder 1 through circular die 2 to form a fibrous network 3. The fibrous network is attenuated upon leaving the die and is quenched, preferably on both surfaces, by two parallel arranged opposed air rings 4A and 4B whereby the network is drawn down and changes from a molten or semi-molten state to a plastic and/or substantially solid polymeric substrate. The fibrous network is passed over heated ring 5 whereby the fibrous network is heated to its optimum temperature for stretching and orientation. In zone D the network is passed over the cold ring or rotating rolls and drawn as a solid cool network utilizing elastic expansion to force the structure over the cool ring or rolls 6.

The foregoing apparatus and process provides a media for facilitating the production of balanced fibrous networks. Two or more concentric circular dies may be utilized to extrude multiple cylindrical networks which are extruded radially and simultaneously quenched and drawn utilizing the previously described apparatus. From the heated ring, the cellular network is forced over the outside of a cool ring and drawn by means of elastic expansion. The angle $\alpha$, at which the cylindrical cellular network passes over the cool expansion ring, ranges from about 75° to 125°, preferably about 85° to 95°. The total draw ratio of the cylindrical cellular network ranges from about 1.5:1 to 8:1. The draw ratio may be calculated from the ratio of A (the initial diameter of the cylindrical extrudate) to B (the final diameter of the cellular extrudate).

Figure 2:
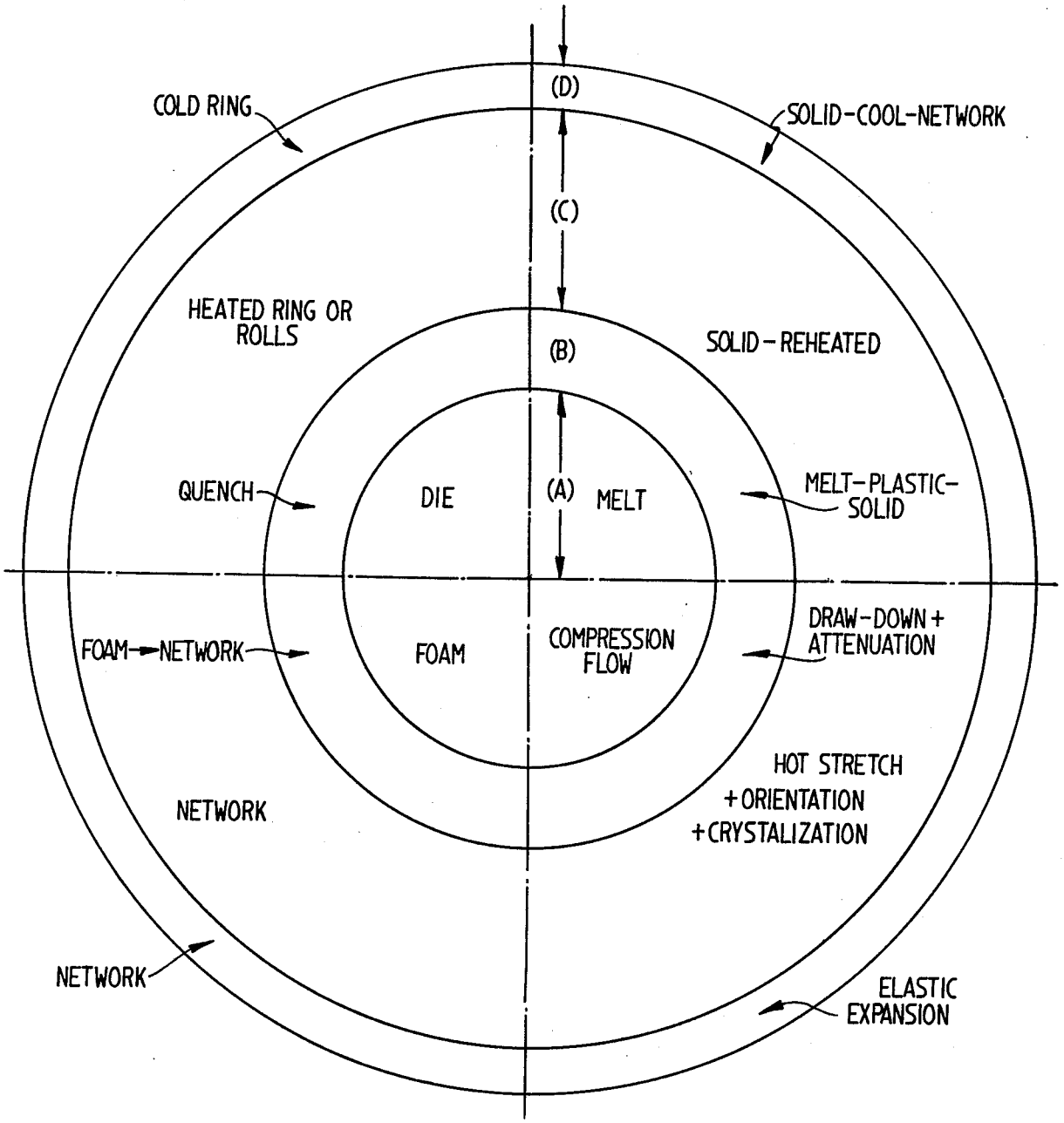
FIG. 2 is a graphic representation of the steps of the process of the present invention.

FIG. 2 is a graphic representation of the process steps of the present invention. In zone A, the polymeric melt is extruded from the die under compression in the form of a foamed cylindrical extrudate. In zone D, the foamed extrudate is quenched, drawn down and attenuated such that the extrudate changes from a melt to a plastic to a solid fibrous network. The network is then passed over a heated ring in zone C to reheat the solid extrudate to facilitate hot stretching, orientation and crystallization. The extrudate is then drawn over a cool ring or rotating rolls in zone D through elastic expansion whereby the solid cool network is drawn to produce a balanced fibrous network. The balanced fibrous networks of the present invention have a substantially uniform cellular structure such that uniform products are easily produced therefrom. Uses for such balanced networks include nonwoven fabrics, decorative scrims, adhesive and fusible scrims, industrial fabrics such as backing fabrics for carpet manufacturing and as a packaging fabric. Other uses may be as an insulating fabric and as a source for yarns and staple fibers.

A better understanding of the invention may be had from the following specific examples. It should be understood that the examples are given for purpose of illustration and are not considered as limiting the sphere or scope of this invention. All parts are by weight and all temperatures are in degrees Fahrenheit, unless otherwise indicated.

EXAMPLE 1

Polypropylene polymer pellets (marketed by Hercules Company under the trade name Profax 6323) having a melt index of 12 were dry blended with 1 percent by weight of azodicarbonamide blowing agent (Celogen AZ - Uniroyal). The blended polymer was fed into the hopper of a 3 -inch diameter extruder having a uniform pitch, single fluted screw, rotating at about 30 R.P.M., the extruder being fitted with a radial die, as shown in FIG. 1, having a diameter of 13 inches. Starting from the rear, the temperature zones were regulated at 390° — 400° — 400° — 400° — 400° Fahrenheit, while the die temperature was also maintained at 400° Fahrenheit.

The polymer was extruded, as shown in FIG. 1, at a throughput rate of 60 lb/hr. The extruded thermoplastic melt was cooled at a controlled rate to below the melting temperature using two opposing air rings supplied with air by a 25 horsepower blower. The air rings had adjustable air gaps set at 0.080 inch. The temperature of the air was maintained at about 80° Fahrenheit. The extrudate was then contacted against the surface of an electrically heated ring having an inside diameter of 22 inches and an outside diameter of 30 inches, as shown in FIG. 1, to heat the fibrous extrudate to a temperature of 200 to 230 degrees Fahrenheit. The extrudate was then passed over a 30.5-inch diameter cooled ring as shown in FIG. 1, maintained at 48° Fahrenheit by circulating cooling water, and the cylindrical extrudate was forced over the outside of this ring through elastic expansion. To minimize machine direction orientation and maximize biaxial orientation, the cooled ring was Teflon coated to reduce friction. Thus, in passing over the cool ring, the cylindrical polypropylene extrudate is biaxially oriented to an expansion ratio of 2.35:1 and the crystalline structure thereof oriented to a substantial degree.

The biaxially oriented extrudate was then collapsed by an internal spreading guide to produce a double layer, flat fabric structure, which was pulled by a pair of nip rolls at 135 feet per minute and wound up on a roll, 40 inches wide by means of a tension controlled surface winder.

The fabric obtained was very fibrous, its weight was 0.6 oz/yd$^2$ (double layer) and it had a strength ratio (strip tensile machine direction/strip tensile transverse direction) of 6 to 1.

A larger quantity of this fabric was used successfully as a quilting scrim in the manufacture of insulated quilted fabrics.

Other portions of this fabric were placed in a secondary operation and embossed-bonded at high speeds into a floral, plain-face and square-weave satin textures.

EXAMPLE 2

Using the apparatus described in Example 1, the following polypropylene resins were extruded:

| Resin | Melt Index | Cool-Ring Expansion Diameter (inches) | Process Speed in Web Formation (ft/min) | *MD/TD Strength Ratio (averaged) |
|---|---|---|---|---|
| A | 1.2 | 35, 40 | 50 – 90 | 9/2.7 |
| B | 4.0 | 35, 40 | 100, 120 | 4/.7 |
| C | 12 | 35, 40 | 100,120,150 | 4/.7 |
| D | 33 | 35, 40 | 100, to soft | 4/.7 |

-continued

| Resin | Melt Index | Cool-Ring Expansion Diameter (inches) | Process Speed in Web Formation (ft/min) | *MD/TD Strength Ratio (averaged) |
|---|---|---|---|---|
| | | | to run | |

*MD/TD - Machine Direction/Transverse Direction tested on a plied and bonded structure. Tests were performed on 1 inch wide specimen and the results are expressed as strip tensile strength in Lb. at break per ounce/yard$^2$ fabric weight.

The resins were foamed during extrusion by injecting Freon-type F-12 into the extruder under pressure by means of an injection pump manufactured by the Wallace & Tiernan Company.

EXAMPLE 3

Using the apparatus described in Example 1, polyethylene terephthalate (Goodyear Chemical Company - VFR 35-99 - I.V. of 0.98) was converted into networks at the following process conditions:

Blowing system - Freon F-12 injection
Extrusion Temperature - Controllers set at 540° F.
Expansion ring, diameter - 35 inches
Extrusion and take-up speed - 100, 150 feet/min.

The product as a fibrous, biaxially oriented network structure of 0.6 ounces/yard$^2$ (two ply lay flat). The MD/TD strength of the bonded network component was about 4/.5 (1 inch strip tensile, lb/oz/yd$^2$). The product width was 48 inches (doubled).

EXAMPLE 4

In the exact arrangement of Example 3, a linear orientation system was placed prior to the winder. Biaxial extrusion stretching followed by linear stretching and orientation was carried out in one continuous system.

The result was a substantially linearly oriented fabric which was more fibrous, porous and open compared to a product of linear extrusion followed by linear stretching.

EXAMPLE 5

Using the apparatus of Example 1, the following polymer systems are converted into biaxially arranged networks:

| Polymer Systems | Extrusion Temperature Degrees F. | Blowing Systems | Radial Die Diameter (Inches) | Expansion Ring Diameter | Wind-up and Process Speed (feet/min.) | Product |
|---|---|---|---|---|---|---|
| a) Polypropylene high density polyethylene | | | | | | |
| 75/25 | 390 | Celogen AZ 1% | 13 | 31½, 35 | 100, 120 | fine fibrous web |
| 50/50 | 390 | 1)Celogen 1%<br>2)Freon,F-12<br>3)Freon,F-114<br>4)Water | 13 | 35 | 120 | very fine fibrous web |
| b) Vinyl Propylene Polymers | 380/390 | Sodium bicarbonate | 13 | 31½ | 60 | very fine fibrous web |
| c) Polyethylene Polypropylene (50/50) | 360/380 | Freon F-114 | 13 | 31.5 | 60 | medium fine, soft web |
| d) Nylon copolymer | 220 | 1)Water<br>2)F-12 | 13 | 30.5 | 30 | very fine fibrous web |

a) Hercules 6323-PP; SD60-050 - Allied high density polyethylene
b) Air Products - 400 series copolymer
c) Northern Petro Chemical Company LDPE
d) Resins obtained from Europe - a fusable fabric type resins

EXAMPLE 6

Using the apparatus of Example 1 with a modified inner quench ring, the angular configuration of radial expansion was determined for one resin, Profax 6323

Hercules polypropylene (M.I.-12). The extrusion and radial expansion system comprised a 13 inch diameter disk and a 35 inch diameter expansion ring. Draw down speed was kept constant at about 100 ft/min.

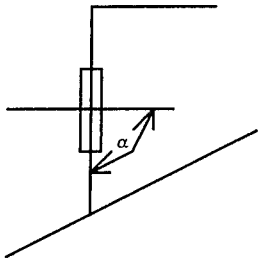

| α (See Fig. 1) | 1" - Strip Tensile (MD plied 10-ply composition) $\frac{lb}{\frac{oz}{yd^2}}$ MD | TD |
|---|---|---|
| 90 | 4 | .8 |
| 80 | 4.2 | .6 |
| 70 | 4.0 | .3 |
| *0 | 4.5 | less than 0.1 |

*This was obtained with a conventional, 4" blown film die having an additional inside quench.

The nonwoven fibrous networks of the present invention are characterized by fibers uniaxially oriented and junction or bond points of biaxially oriented film tissue and fibers in the plane of the fabric, the fibers being primarily oriented in the machine direction (the direction of extrusion) and the biaxially oriented film tissue being oriented in the cross direction (perdendicular to the direction of extrusion). The fibers have a substantially irregular cross section whereas the film tissue is substantially like a ribbon and has a relatively flat cross section. The tissue may be characterized as a transparent, extremely thin film. The nonwoven fabrics of this invention are biaxially oriented to such an extent that the junctions are substantially stronger than the majority of the interconnecting fibers or filaments. The balance in the biaxial behavior of the fibers improves the strength ratio, filament strength/junction strength, increases at higher levels of radial stretch and orientation.

Because perpendicular pressure caused by mandrel stretching is not involved, fabrics of multi-layed filament thickness are produced. The radial attenuation process produces filaments from the molten foam and further stretches them without external pressure, producing a three-dimensional fabric. This third dimension can be controlled by the polymer melt-flow properties, the thickness and cell structure of the initial foam and the cooling rate during quenching. In addition, vibration induced by the quench during melt-fiber attenuation enhances fiber entanglement and additional crossover fiber junctions. A high degree of fiber attenuation is achievable by the process of this invention and stretch ratios may be employed to such a magnitude that it exceeds the attenuation limit of some of the smaller filaments, causing them to break and, thus, producing oriented, opened-end filaments.

The process of the present invention is based upon the ability to attenuate a radially extruded foamed melt, radially, into a fibrous web and further, radially stretching the solidified fibrous melt into a biaxially oriented fabric utilizing a 360 degree circular ring, but preferably a rotating pull roll. The applied stresses are initiated radially and maintained radially over the entire structure from the die to the outside diameter of the pull roll or ring. The molten foam is drawndown radially into a fibrous structure during and prior to solidification and after-stretching. The ability to orient the fibers and junction points is limited only by the resistance of the fibers to attenuation during actual stretching, since external and frictional restraints are substantially absent in the present process. Polymer-fiber orientation, therefore, can be optimized to the highest degree, limited only by the inherent properties of the polymer system.

For a given orientation system, a fiber is considered oriented to the highest level if further stretching will break the fiber being attenuated. Therefore, the maximum stress for stretching must be just below the breaking stress of the fiber under stretching conditions. In the radial extrusion and expansion process of the present invention, optimization to such a high degree of stretching is possible considering the heterogeneous nature of the fibrous assembly produced. The process can be carried out to the extreme, to the point of breakage of some of the fibers in the web, during stetching. The foam-stretch radial expansion system therefore allows the application of the maximum stress for stretching to some of the fibers of the nonwoven fibrous network.

The present invention provides an apparatus for producing nonwoven fibrous networks comprising an extruder fitted with a circular radial die for extruding a cellular extrudate, circular quenching means providing a circular quench path extending radially out from the radial die, means for heating the extrudate, circular drawing means positioned radially around the circular die and means for forcing the extrudate over the outside of the drawing means at an angle of from about 75° to 125°, preferably from about 85° to 95°. The ratio of the diameter of the circular radial die to the diameter of the drawing means preferably ranges from about 1:1.5 to 1:8. The quenching means preferably comprises two parallel arranged opposed air rings and the drawing means preferably comprises a plurality of circularly arranged rotating rolls, which eliminate friction between the extrudate and the drawing means.

What is claimed is:

1. A process for producing a nonwoven fibrous network comprising extruding a mixture of a molten thermoplastic polymer and a foaming agent radially under compression through a circular die having a die gap substantially transverse to the axis of the die head, applying radial stress to said molten thermoplastic polymer to attenuate said molten thermoplastic polymer to form a molten fibrous cellular extrudate, maintaining radial stress over the entire molten fibrous extrudate to further attenuate said fibrous extrudate, quenching said extrudate to a temperature below its melting or flow temperature and further radially stretching said extrudate to provide a balanced nonwoven fibrous network.

2. The process of claim 1 wherein the concentration of the foaming agent ranges from about 0.25 to 10 percent by weight of the thermoplastic polymer.

3. The process of claim 1 wherein the extrudate is finally stretched at an angle of from 75° to 125° in relation to the direction of radial extrusion.

4. The process of claim 3 wherein the extrudate is radially stretched at an angle of from 85° to 95°.

* * * * *